United States Patent [19]

Lorenz et al.

[11] 4,259,157

[45] Mar. 31, 1981

[54] METHOD OF PRODUCING ABRASION-PROOF COKE FORMS FROM BITUMINOUS COAL, BROWN COAL OR PEAT BRIQUETS

[75] Inventors: Kurt Lorenz, Hattingen; Horst Dungs, Herne; Hans B. Koenigs, Bergheim; Roman Kurtz, Frechen, all of Fed. Rep. of Germany

[73] Assignees: Firma Carl Still GmbH & Co. KG; Rheinische Braunkohlenwerke Aktiengesellschaft, both of Fed. Rep. of Germany

[21] Appl. No.: 30,939

[22] Filed: Apr. 17, 1979

[30] Foreign Application Priority Data

Apr. 27, 1978 [DE] Fed. Rep. of Germany ..... 2818456

[51] Int. Cl.[3] ..... C10B 39/00; C10B 57/10; C10B 47/20; C10L 5/28

[52] U.S. Cl. ..... 201/39; 201/6; 201/34; 201/44; 44/10 R; 202/125; 202/150; 432/31

[58] Field of Search ..... 201/5, 6, 34, 39, 41, 201/44, 13, 14; 202/124, 150, 120, 125, 126, 127, 121; 44/10 R, 10 C, 10 K; 432/13, 18, 31, 178, 188

[56] References Cited

U.S. PATENT DOCUMENTS

| | | | |
|---|---|---|---|
| 849,947 | 4/1907 | Wagner | 202/150 X |
| 1,408,640 | 3/1922 | Roberts | 202/150 X |
| 1,733,747 | 10/1929 | McIntire | 202/126 |
| 1,893,555 | 1/1933 | Komarek et al. | 201/44 X |
| 1,909,421 | 5/1933 | Parr et al. | 201/44 X |
| 1,983,801 | 12/1934 | Hillstrom | 202/124 |
| 2,074,881 | 3/1937 | Witting | 202/150 X |
| 2,847,369 | 8/1958 | Hughes et al. | 202/120 |
| 3,316,155 | 4/1967 | Holowaty et al. | 201/6 |
| 3,663,186 | 5/1972 | Dzhaparidze et al. | 201/6 X |
| 4,050,990 | 9/1977 | Lorenz | 201/6 X |
| 4,134,794 | 1/1979 | Lorenz et al. | 201/34 X |

FOREIGN PATENT DOCUMENTS

| | | | |
|---|---|---|---|
| 672168 | 5/1952 | United Kingdom | 202/120 |

*Primary Examiner*—Frank W. Lutter
*Assistant Examiner*—Roger F. Phillips
*Attorney, Agent, or Firm*—John J. McGlew

[57] ABSTRACT

Abrasion-proof coke forms are produced from bituminous coal, brown coal, or peat in the form of briquets, by preheating the briquets, dehydrating or predrying them, carbonizing them and then cooling them in at least three separate stages in which the briquets are dehydrated indirectly by subjecting them to indirect temperature conditions, producing a temperature gradient in the briquets. The briquets are automatically fed into a shaft tower which includes an upper drying shaft portion made up of a plurality of stacked radiators which include tube elements for the passing of a heating fluid, such as steam, therethrough and which define vertical shaft passages through which the briquet forms are passed downwardly and into a carbonizing shaft which has separate gas channels for directing heating gases therethrough and to a heating flue and which subsequently includes a lower cooling zone through which the briquets pass and then into a discharge channel where they are delivered for classification.

10 Claims, 8 Drawing Figures

METHOD OF PRODUCING ABRASION-PROOF COKE FORMS FROM BITUMINOUS COAL, BROWN COAL OR PEAT BRIQUETS

FIELD AND BACKGROUND OF THE INVENTION

The present invention relates to a method of, and apparatus for, producing abrasion-proof coke forms from bituminous coal, brown coal, or peat in the form of briquets in which the briquets are preheated, dehydrated or predried, carbonized, and then cooled, in at least three stages.

DESCRIPTION OF THE PRIOR ART

A method of producing abrasion-proof coke forms from brown coal briquets is known, in which the brown coal briquets are preheated, dehydrated or predried, carbonized and then cooled by means of circulated gases which substantially comprise the burned lean gas of the carbonization. The gas circuits of the carbonization process are heated and the cooling circuit is cooled. A separate closed gas circuit is provided both for the preheating and the dehydration or predrying and these gas circuits are each heated separately. (See German Auslegesschrift No. 2,507,735).

In this method, cooled lean gas from the carbonization stage may be added to the circulated gas prior to its reentry into the carbonization stage and the gas circuits of each stage may be separately dedusted with their rate of flow being reduced to about 0.2 to 2.0 meters per second. In order to control the speed of dehydration, steam may also be added to the gas circuits of the preheating and the dehydration or drying. (See German Auslegesschrift No. 2,537,191). These measures are comprehensively substantiated in the two cited German papers.

It is substantial for the above-described method of producing coke that the heating of the briquets or forms is carried out at such a speed that at no time do substantial stresses or excess pressures occur in the interior of their structures; and that a simultaneous expulsion of the volatile components and shrinking is obtained. That is, at any instant, the expulsion in weight of the volatile components corresponds to the shrinking in volume. Thereby, substantial changes of the apparent density of the forms is avoided.

The method described in the foregoing has proved satisfactory in practice and is used for producing abrasion-proof coke forms. Experience has shown, however, that the economy of the method is unfavorably influenced by the necessity or circulating large amounts of gas, of their reheating, and by the costs of the necessary equipment to carry out this method.

SUMMARY OF THE INVENTION

The present invention is directed to a method in which no large gas amounts are to be circulated, and the costs of equipment are smaller. To this end, it is provided that the bituminous coal, brown coal, or peat briquets are preheated and dehydrated indirectly and under such conditions, that a temperature gradient is produced in the briquets. In a most simple manner, with the briquets moved vertically, the heat is supplied from the side. At the same time, it is advantageous to locate the heat-supplying radiators or walls at locations which are spaced from each other by distances equalling 2 to 10 times the diameter of the briquet.

In accordance with the invention, the briquets pass the stages of preheating and dehydration, for example, in structures made up of heatable finned radiators, into which the unit briquets are placed from above by means of conventional conveyors. It is well known that a too rapid drying leads to crack formation in the briquets, especially if they still contain moisture. The formation of cracks may be overcome by providing long periods of dwell in the preheating and drying stages, with correspondingly low temperatures.

In the direct drying of briquets by means of hot gases or steam, the forms are exposed to the flow of hot gas on all sides. The drying progresses in the central direction from the outside to the inside and water vapor from inside the briquet must penetrate to the outside through the whole surface thereof. This easily causes internal stresses in the briquet which eventually leads to the crack formation. The simultaneous drying from all sides produces a certain degree of shrinking.

Steam escape on the one hand, and shrinking, on the other hand, produce forces acting on the structure of the briquet and result in tensional stresses, and if these stresses exceed an admissible value, they produce deep hair fissures which weaken the briquet structure form at the outer, already dried shell, depending on the temperature gradient within the briquets.

Surprisingly, it has been found that the formation of cracks in the briquets during preheating and dehydrating can be prevented by the inventive unilaterial supply of heat. This may be due to the fact that, for example, with a unilateral heating, both the water vapor and the carbonization gases forming in the briquet can escape to the other side. A particularly distinct unilateral temperature gradient is produced in those briquets which are adjacent the wall through which the heat is supplied. Experience has shown, however, that even the briquets which are not adjacent the heating radiators and receive their heat partly by radiation from the wall and partly by heat transfer through the adjacent briquets, do not tend to crack formations.

The inventive preheating and drying method is carried out by means of heating plates which are heated, for example, by saturated steam, a heat carrier oil, or other fluid heat carriers. Advantageously, the heating plates are assembled to heat radiators. For example, coal forms having a diameter of about 50 mm slide through vertical shaft structures which are formed by heating plates spaced by about 10 cm and in which the forms are dried and heated. In the dehydration zone, the briquets are preheated, preferably to 120° C. to 180° C., prior to entering the carbonization stage.

The heating radiators are arranged in parallel and side-by-side, as needed, that is, depending on the length of the oven. The number of the heating radiator layers, placed one above the other, is chosen so as to be able to set the necessary period of dwell.

For example, the preheating and drying shafts will have dimensions of about 2.8 m in width, about 10 m in length and 11 m in height and will be placed above two vertical coking chambers which are parallel to each other and have a width of approximately 0.4 m, a length of approximately 10 m, and a height of approximately 10 m. Such a plant attains an output per hour of about 6 metric tons of high temperature coke if charged with brown coal briquets. The dehydration shafts or radiators are gas-tightly connected to the coking chambers, for example, by means of rectangular flexible tubes.

The advantage of the inventive indirect drying relative to the known direct drying is that no gas locks are necessary between the drying stage and the carbonization stage, since only water vapor is present in the drying stage and no mixture of water vapor and combustion gases.

The operation of the carbonization stage is substantially simpler, since it can be operated with a pressure difference of about ±0 relative to the atmospheric pressure. This is advantageous not only for monitoring the combustion in the heating flues of the carbonization stage and for the equipment of the observation stations, but also because the sheet jacket of the carbonization stage is not exposed to any pressure and can accordingly be of a correspondingly light construction.

Since, in accordance with the inventive method of preheating and drying, no gas amounts are to be circulated, there is no need for a costly gas dedusting and no dust deposits will form which would make periodical cleaning of the plant necessary. Further, in contradistinction to the prior art, no gases having a non-separable residual dust content are discharged according to the inventive method of preheating and drying. The inventive method is thus compatible with the environment.

Water vapor develops during the drying of the briquets and it has been found advisable to take off a portion, namely, about 5% to 20% of the developing water vapor along with the crude gas of the carbonization stage, while the remaining portion of the water vapor escapes from the briquet charge at the upper end of the preheating radiator and is discharged into the atmosphere. Mechanical gas locks can thus be omitted with the inventive method.

It is also possible to take off the greatest part of the water vapor at the upper end of the preheating stage and to condense it in a direct system by means of cold water. Advantageously, a collecting hood is provided above the preheating stage and is connected to a ventilator chimney. The plant may be charged at the upper end of the preheating stage in a continuous or discontinuous manner by means of a feeding belt. The briquets are uniformly distributed over the entire cross-sectional area of the opening.

As to the temperature regime, the preheating stage and the drying stage together may be subdivided into three stages: If the stages are heated with saturated steam, the temperature of the steam is set in the upper stage to 130° C. to 160° C.; in the middle stage to 150° C. to 190° C., and in the lower stage, to 190° C. to 230° C.

The design may be such that the amount of condensate flowing out of each stage is made visible and that the amount of saturated steam at the inlet of the stage is indicated by a display fitting. While designing the heating equipment, protective wear plates may be provided on the outer surfaces of the heating plates, that is, on the radiators receiving the heating fluid.

Aside from these technological advantages of the inventive method, the economic advantages are also of importance. It is true, for example, that saturated steam for the preheating and drying is more expensive than purified gas from the plant used for direct drying. However, a better total efficiency results from the lower heat losses and from the fact that no blower energy is needed.

Additionally, as compared to the prior art, the costs of equipment are substantially lower and are estimated to about 60% for a comparable performance.

Accordingly, an object of the present invention is to provide an improved method for producing abrasion-proof coke forms from bituminous coal, brown coal or peat, in the form of briquets, which comprises, directing the briquets uniformly into a drying shaft in which the coke is passed through vertical passages defined by spacings between fluid-containing pipes or channel members through which a heating medium is passed, and subsequently, directing them downwardly through a carbonization shaft in which heating gases are passed to carbonize the briquets, subsequently cooling the briquets and then discharging them from the heating shaft sections.

Another object of the invention is to provide an apparatus for carrying out the method of the invention to produce abrasion-proof coke which includes an elongated shaft construction including an upper section made up of a plurality of stacks of vertically arranged radiators, each comprising horizontally extending tubes through which a heating fluid is adapted to pass so that when the briquets are passed through the spaces between the tubes of the radiators, they are preheated and predried by indirect heating, with the vertical ducts defined between the radiator tube spaces being connected downwardly into a carbonizing shaft which has means for directing heating gases therethrough for the carbonizing of the coke briquets and which further includes a cooling zone at the lower end thereof which connects to a discharge for the coke.

A further object of the present invention is to provide an apparatus for producing abrasion-proof coke which is simple in design, rugged in construction and economical to manufacture.

The various features of novelty which characterize the invention are pointed out with particularity in the claims annexed to and forming a part of this disclosure. For better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
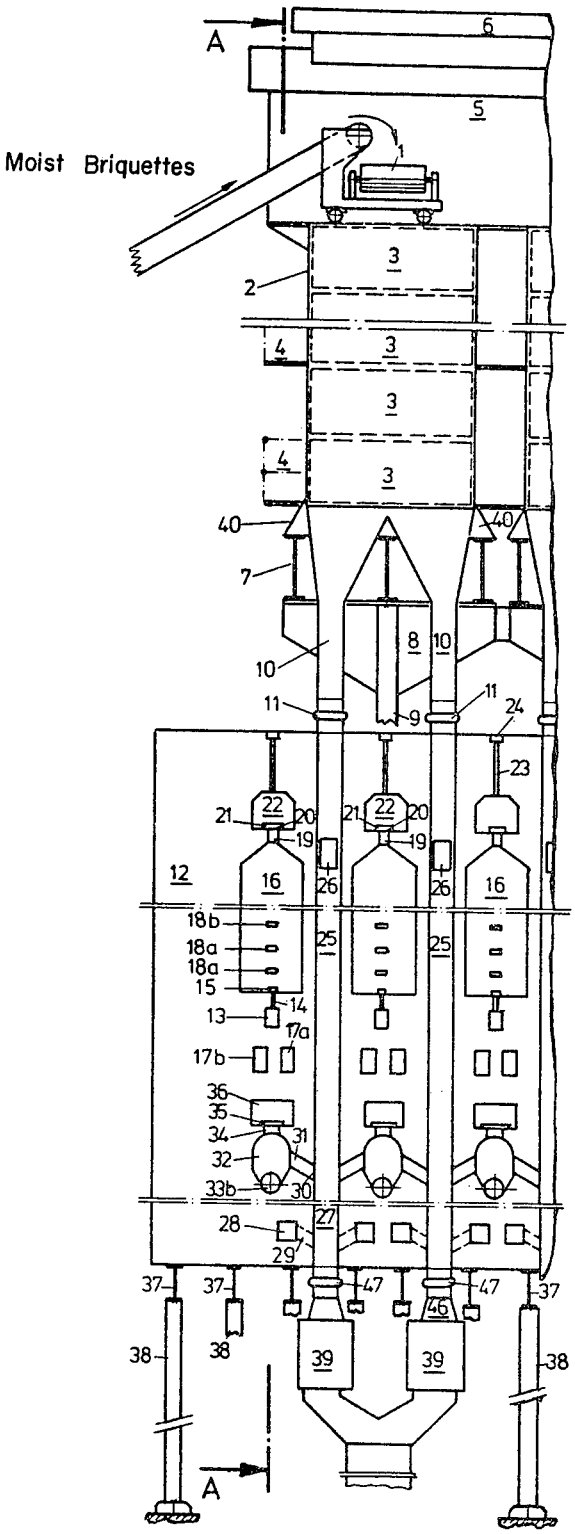
FIG. 1 is a cross-sectional view of the drying, carbonizing and cooling stages and the discharge of a device for carrying out the inventive method.

Referring to the drawings in particular, the invention embodied therein, comprises, a method of producing abrasion-proof coke forms from bituminous coal, brown coal, peat, etc., in the form of briquets which are preheated, dehydrated or predried and carbonized, and then cooled, in at least three stages and, wherein, the briquets are subjected indirectly to a temperature sufficient to preheat them under conditions producing a temperature gradient in the briquets.

In the preferred form of the invention, the preheating and predrying is carried out by directing the briquets through vertically extending channels in a drying shaft which are formed by heating tube elements of radiators through which a heating fluid, such as steam, is passed.

According to FIG. 1, the moist briquets are charged at the head of the shaft oven by means of a charging device 1 and are distributed over the entire cross-sectional area of a drying shaft 2. Finned heating radiators 3 are provided in drying shaft 2 and they are heated by means of steam or thermal oils or other fluid heat carriers. The drying shaft 2 is subdivided into three temperature zones which can be reached from platforms 4. A roof cover 5 with a steam discharge latern 6 is provided above the drying shaft. Drying shaft 2 is supported on beams 7 which, in turn, are supported by cross-beams 8 and uprights 9.

The connection between the drying shaft 2 and a coking block or carbonization shaft 12 is effected by flexible tubes 10 which have a rectangular cross-section and are equipped with compensators 11. The carbonization shaft 12 is a vertical chamber oven with indirect, stepped heating. Heating gas is supplied to the heating flues 16 through channels 17*a*, 17*b* and through a channel system (not shown) in the heating flue binders and slots 18*a*, 18*b*. With this separated air supply, the combustion may be controlled in a satisfactory manner over the whole height of the heating flues.

The flue gases which are present in the heating flue leave the same through an opening 19 and pass through a calibration or orifice 20 equipped with a control gate 21 into the upper horizontal channel 22. From there, the flue gases are taken off to both sides or, if the heating wall is short, only to one side. Individual gas channels 23 are provided, each over one heating flue 16, between the upper horizontal channel 22 and the roof. The channels are designed in such a manner that the combustion may be observed from the roof of the coking shaft. These channels are closed on the shaft roof with a cover 24.

The carbonization takes place in vertical coking chambers 25. The crude gas produced during the carbonization is taken off to the outside through an opening 26. In the lower zone of the coking shaft, a cooling stage 27 is connected without a transition. Cold gas for cross-channels 29 is supplied through a longitudinal channel 28 into cooling zone 27 of vertical carbonization chambers 25. From there, the hot cooling gas passes through openings 34, which are equipped with calibration plates 35, into the hot gas return channel 36 where it is taken off through a gas cooler (not shown) by an exhauster and directed back to the cooling gas channel 28.

Carbonization chambers 25 with their cooling zone 27 are supported by beams 37 resting upon uprights 38. The coke is uniformly discharged below the cooling zone and over the entire length of the oven by a device which is installed in the discharge channel 39, and from there, it is transported to a common discharge lock (not shown) and then to a coke classification section.

Figure 2:
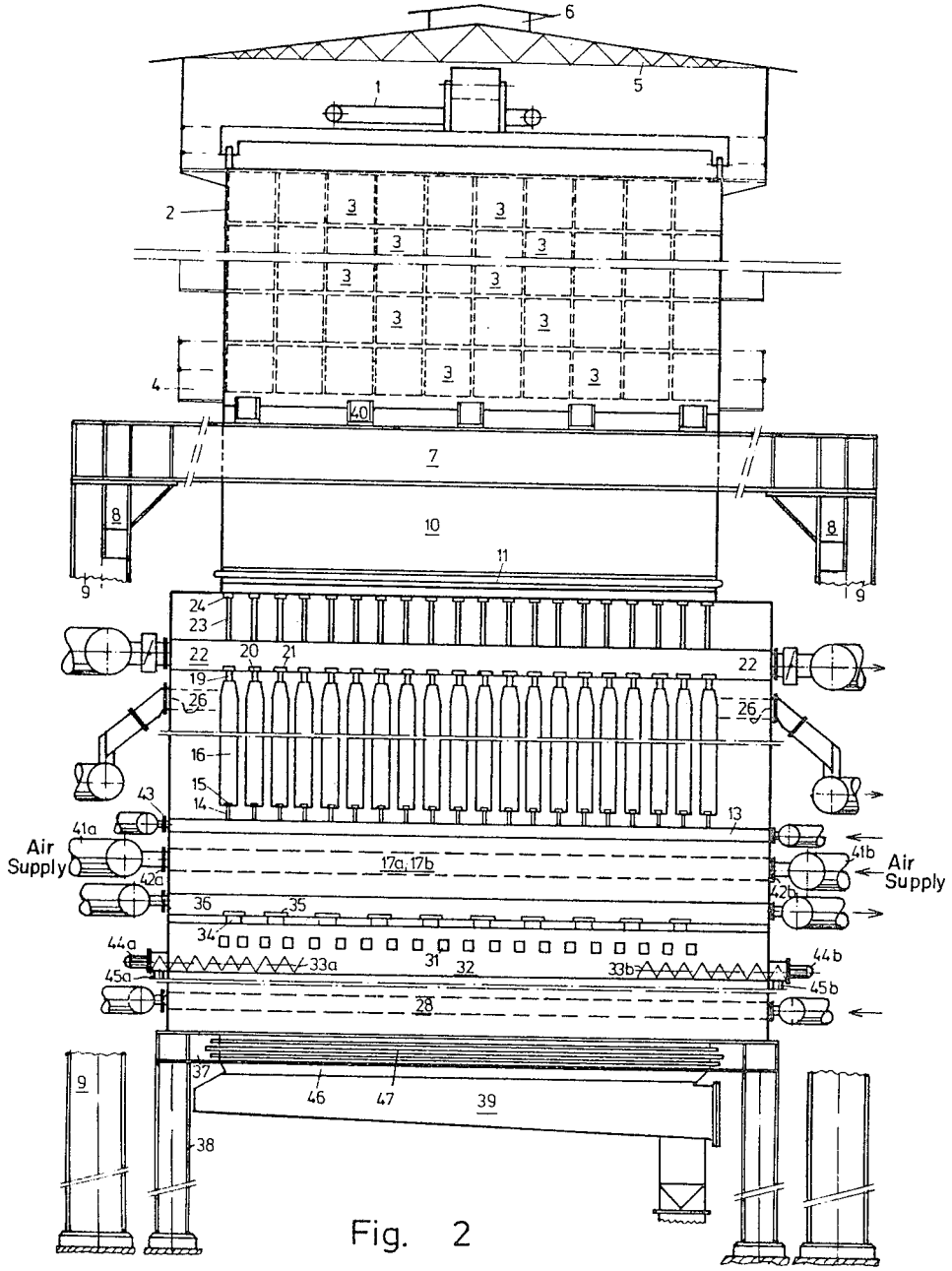
FIG. 2 is a longitudinal sectional view of the drying, carbonizing and cooling stages and the discharge, taken along the line A—A of FIG. 1.

The briquets are uniformly distributed over the upper cross-sectional area of the structure of finned heating radiators 3 by means of briquet-charging device 1, as seen in FIG. 2. Radiators 3 are aligned in shaft 2 and they are disposed one above the other and may be removed individually, independently of the heating radiators which are located at their side. In a lower zone at the lower edge of shaft 2, supporting elements 40 are provided by means of which the drying shaft is supported on longitudinal beams 7. The distance between the lower edge of longitudinal beam 7 and the upper edge of the carbonization shaft 12 is sufficient to ensure head room. Each heating flue 16 between flexible tubes 10 can be checked through observation channels 23 and the temperatures may be measured and contolled by regulating the control gates 21.

An air channel 17*a*, as shown in FIG. 2, is supplied through line 41*a* and an air channel 17*b* is supplied through line 41*b*. Air channels 17*a* and 17*b* are so dimensioned that, in emergency cases, the entire air supply for one heating wall can be supplied through one line. The uniformity of the air supply to the individual heating walls is ensured by calibration plates 42*a* and 42*b*. The uniform distribution of the heating gas is effected by perforated plates 43.

In the lower portion of heating gas cooling channel 32, dust discharge screws 33*a* and 33*b* are provided, which extend up to the center of the oven and convey the dust toward the front side of the heating wall. The screws are driven by motors 44*a* and 44*b*. The dust is conveyed through connections 45*a* and 45*b* and through locks to the outside. The cooling zone 27 of FIG. 1 communicates with a discharge channel 39 through a box-type intermediate piece 46 to which compensators 47 are welded.

Figure 3:
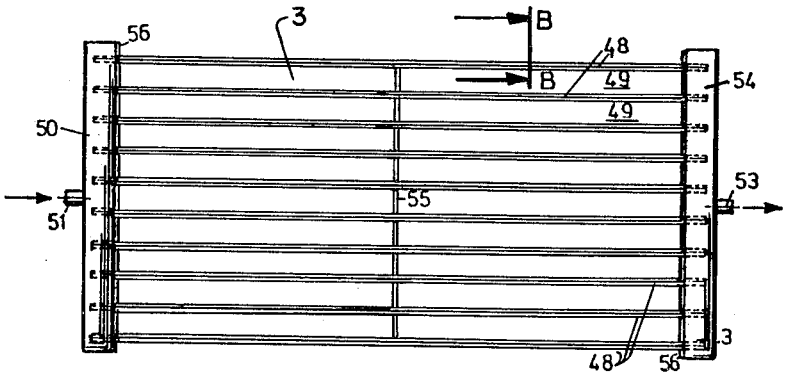
FIG. 3 is a top plan view of a finned heating radiator, shown in FIG. 1.

In FIG. 3, the heating plate elements are shown at 48. They are spaced horizontally from each other by a distance of 10 cm and together form the shafts 49 through which the briquets pass from above downwardly and are dried during this passage by indirect heat transfer. The heating fluid which, in the present example, comprises saturated steam, is supplied through a distributor 50 and a supply connection 51.

The condensate produced during the condensation of the saturated steam accumulates in accumulator 52 (FIG. 4) and is drawn off through a connection 53 to the outside. Cross-beams 54 which are also designed in the form of a distributor or accumulating tube serve the purpose of stabilizing the heating radiators. A spacer 55 is provided for the heating plate elements 48, and it is disposed in the middle of the finned heating radiators 3. Further shown are protective sheets 56 which keep the briquets off the outer walls 2 of the shaft.

Figure 4:
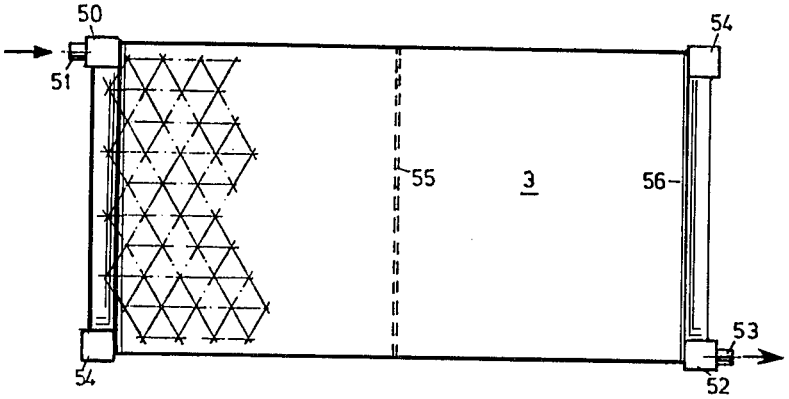
FIG. 4 is an elevational view of the longitudinal side of a finned heating radiator.

The position of distributors 50 and collectors 52, as well as of cross-beams 54, is shown in FIG. 4.

Figure 5:
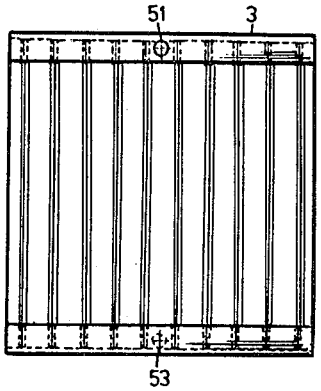
FIG. 5 is a front view of a finned heating radiator.

FIG. 5 shows the position of the supply connections 51 and of the discharge connection 53 of the heating radiator 3.

Figure 6:
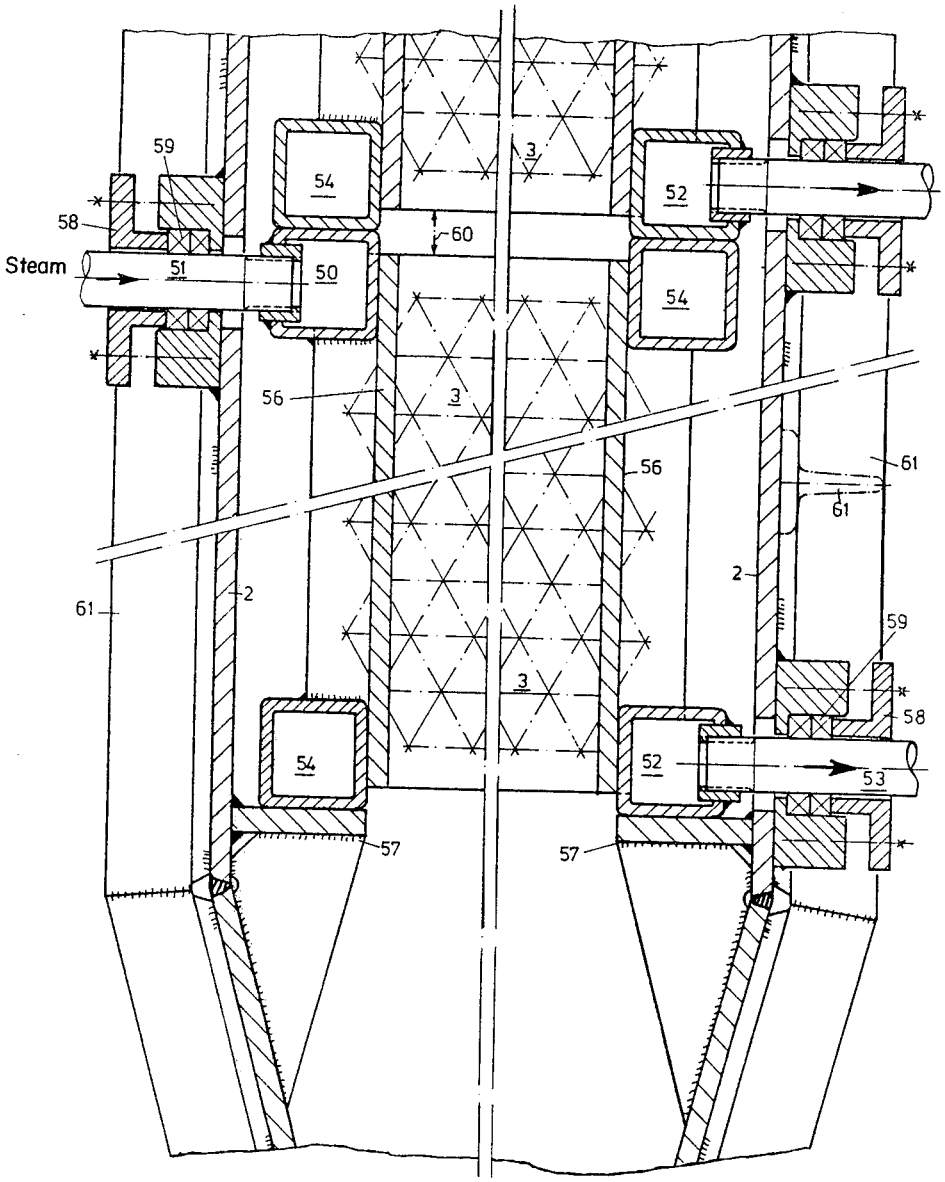
FIG. 6 is an elevation view of a mounted finned heating radiator according to FIG. 3.

In FIG. 6, the heating radiator 3, with the cross-beams 54 and collector 52 of the drying shaft 2, is shown freely supported on brackets 57. The supply connection 51 is screwed into distributor 50. The wall of the drying shaft 2 is sealed by means of a box 58 and packing 59. This makes it possible to replace the heating radiator at any time. The individual finned heating radiators 3 are placed one above the other, as shown, so that the cross-beams and distributors and cross-beams and collectors always superpose each other. Protective sheets 56 prevent the briquets from sliding to the outer wall of the shaft and make the removal of the finned heating radiators 3 difficult.

The vertical spacing 60 of the heating plates from radiator 3 to radiator 3 is about 15 mm at most. With this small spacing, a forming of a bridge by the briquets sliding down is prevented. Reinforcing ribs in the outside of the shaft are shown at 61. The ribs, at the same time, serve as a support for the outside insulation of the shaft (not shown).

Figure 7:
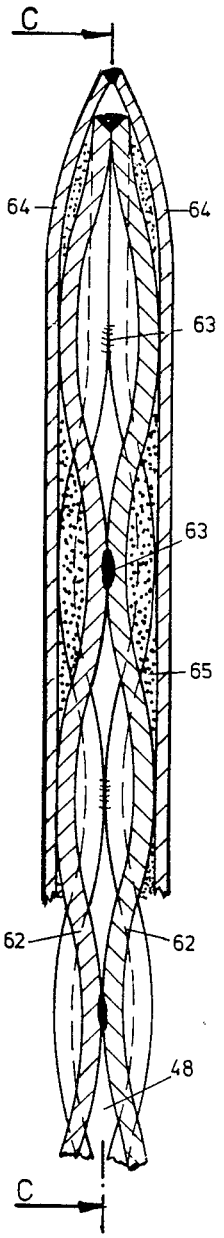
FIG. 7 is a cross-sectional view, taken along the line B—B of FIG. 3.

Pressure-supporting plates 62 are shown in FIG. 7. The cavity between pressure-supporting plates 62 serves the purpose of receiving the heating fluid and can stand pressures of up to 25 atm. in excess. Plates 62 are of a composite construction resembling a comforter. The plates are connected to each other by spot-welding at 63 in a triangular or similar configuration. The convex shape of the plates is obtained by pressure, up to the necessary degree of deformation.

Wearing plates 64 are provided on the outside of the pressure-supporting plates 62, and on both sides of the plates, so as to prevent wear of the pressure-supporting wall. The gaps between the pressure-supporting plates 64 and the wear plates are filled with a good heat-conducting material 65, for instance, thermally conducting cement. Heating plates 48 have a thickness of about 10 mm measured from outside-to-outside.

Figure 8:
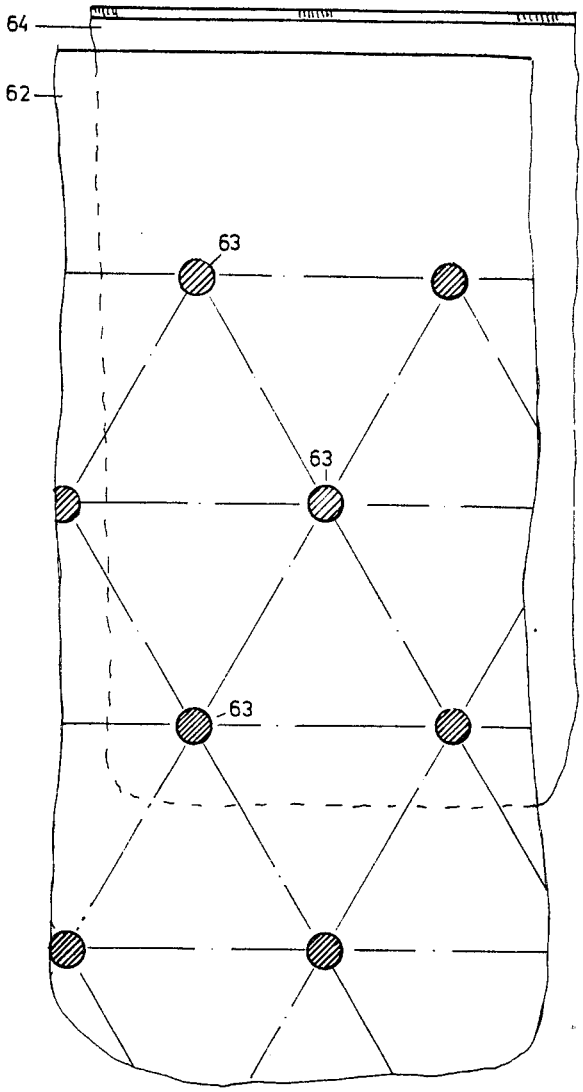
FIG. 8 is a longitudinal sectional view taken along the line C—C of FIG. 7.

The pattern of the spot-welding connection 63 is shown in FIG. 8.

While a specific embodiment of the invention has been shown and described in detail to illustrate the application of the principles of the invention, it will be understood that the invention may be embodied otherwise without departing from such principles.

What is claimed is:

1. In a method of producing non-abrasive coke forms of briquets from bituminous coal, brown coal or peat in at least three separate stages in which the briquettes are preheated, dehydrated or dried, carbonized and subsequently cooled, the improvement wherein the steps of preheating and dehydrating comprises exposing the briquets to a unilateral heat source in indirect heat transfer therewith thereby forming a unilateral temperature gradient in the briquets.

2. The improved method of claim 1, wherein said exposing step comprises passing the briquets adjacent to a unilateral indirect heat source.

3. A method of producing abrasion-proof coke from moist briquets using a drying shaft of the type having a plurality of radiators which are horizontally spaced and arranged in vertical stacks so as to define vertical shaft passages therebetween, which comprises passing a heating medium through the radiators, passing the briquets into the vertical shaft passages and exposing the briquets to unilateral indirect heat transfer with the heating medium within said radiators so as to heat the briquets indirectly.

4. A method, as claimed in claim 3, wherein said exposing step is carried out in shaft passages are formed by walls which spaced apart from each other by distances corresponding to at least 2 to 10 times the diameter of the briquets.

5. A method, as claimed in claim 3, wherein said exposing step is carried out with radiators comprising heatable finned radiators.

6. A method, as claimed in claim 3, wherein the heating medium comprises saturated steam.

7. A method, as claimed in claim 3, wherein the heating medium comprises a heat carrier oil.

8. A method, as claimed in claim 3, wherein said exposing step comprises heating the briquets to a temperature of 120° to 180° C. to effect the dehydration thereof.

9. A method, as claimed in claim 3, or 5, or 6, or 7 or 8, further comprising the step subsequently carbonizing the briquets and then cooling the briquets.

10. A method, as claimed in claim 3, wherein said exposing step comprises first heating the briquets in a temperature range of 130° C. to 160° C., the heating the briquets in a temperature range of 150° C. to 190° C., and next heating the briquets in the temperature range of 190° C. to 230° C.

* * * * *